US008118188B2

(12) United States Patent
Xin

(10) Patent No.: US 8,118,188 B2
(45) **Date of Patent: *Feb. 21, 2012**

(54) FASTENING CLIP AND PACKAGE USING THE SAME

(75) Inventor: Shuang-Ming Xin, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 769 days.

This patent is subject to a terminal disclaimer.

(21) Appl. No.: 12/253,938

(22) Filed: Oct. 17, 2008

(65) Prior Publication Data

US 2009/0229092 A1 Sep. 17, 2009

(30) Foreign Application Priority Data

Mar. 12, 2008 (CN) ..... 2008 1 0300547

(51) Int. Cl.
*B65D 45/16* (2006.01)

(52) U.S. Cl. ..... 220/324; 220/326

(58) Field of Classification Search ..... 206/600; 220/324, 326, 825, 826; 24/458
See application file for complete search history.

(56) References Cited

U.S. PATENT DOCUMENTS

| | | | | |
|---|---|---|---|---|
| 4,019,764 | A * | 4/1977 | Okamura | 292/288 |
| 4,239,149 | A * | 12/1980 | Kupersmit | 229/125.21 |
| 5,100,015 | A * | 3/1992 | Vanderstuyf | 220/326 |
| 5,234,124 | A * | 8/1993 | Buckner et al. | 220/326 |
| 6,814,225 | B2 * | 11/2004 | Belden et al. | 206/1.5 |
| 7,908,719 | B2 * | 3/2011 | Liverman et al. | 24/453 |
| 2004/0195241 | A1 * | 10/2004 | Stull et al. | 220/326 |
| 2009/0211068 | A1 * | 8/2009 | Xin | 24/458 |

FOREIGN PATENT DOCUMENTS

| | | | |
|---|---|---|---|
| CN | 200967582 | Y | 10/2007 |
| CN | 201023751 | Y | 2/2008 |

* cited by examiner

*Primary Examiner* — David Fidei
(74) *Attorney, Agent, or Firm* — Altis Law Group, Inc.

(57) ABSTRACT

An fastening clip includes a main body defining a through hole, a flange radially extending from the main body, a first clipping member hinged on the main body, a second clipping member hinged on the main body and comprising a first latching portion, and a latching mechanism extending from the first clipping member and comprising a second latching portion and a release tab. The clip has first and second positions. In the first position, the first and second clipping members extend out of the through hole, and the second latching portion can engage with the first latching portion. In the second position, the first and second clipping members are received in the through hole. When the release tab is operated, the release tab can engage the second clipping member to make the second latching portion disengage from the first latching portion.

18 Claims, 8 Drawing Sheets

3

3

FASTENING CLIP AND PACKAGE USING THE SAME

CROSS-REFERENCE TO RELATED APPLICATION

The present application is related to a copending U.S. patent application, titled "FASTENING CLIP AND PACKAGE USING THE SAME", with the application Ser. No. 12/211,817, assigned to the same assignee as the present application, the disclosure of which is incorporated herein by reference.

BACKGROUND

1. Technical Field Disclosure

The disclosure relates to packaging and, more particularly, to a fastening clip and a package using the clip.

2. Description of Related Art

Referring to FIG. 1, a typical method for receiving a product 1 in a typical package 2 is shown. However, it can be inconvenient to put the product in, or take it out of, the package 2 if the product 1 is bulky or heavy.

DETAILED DESCRIPTION

Figure 1:
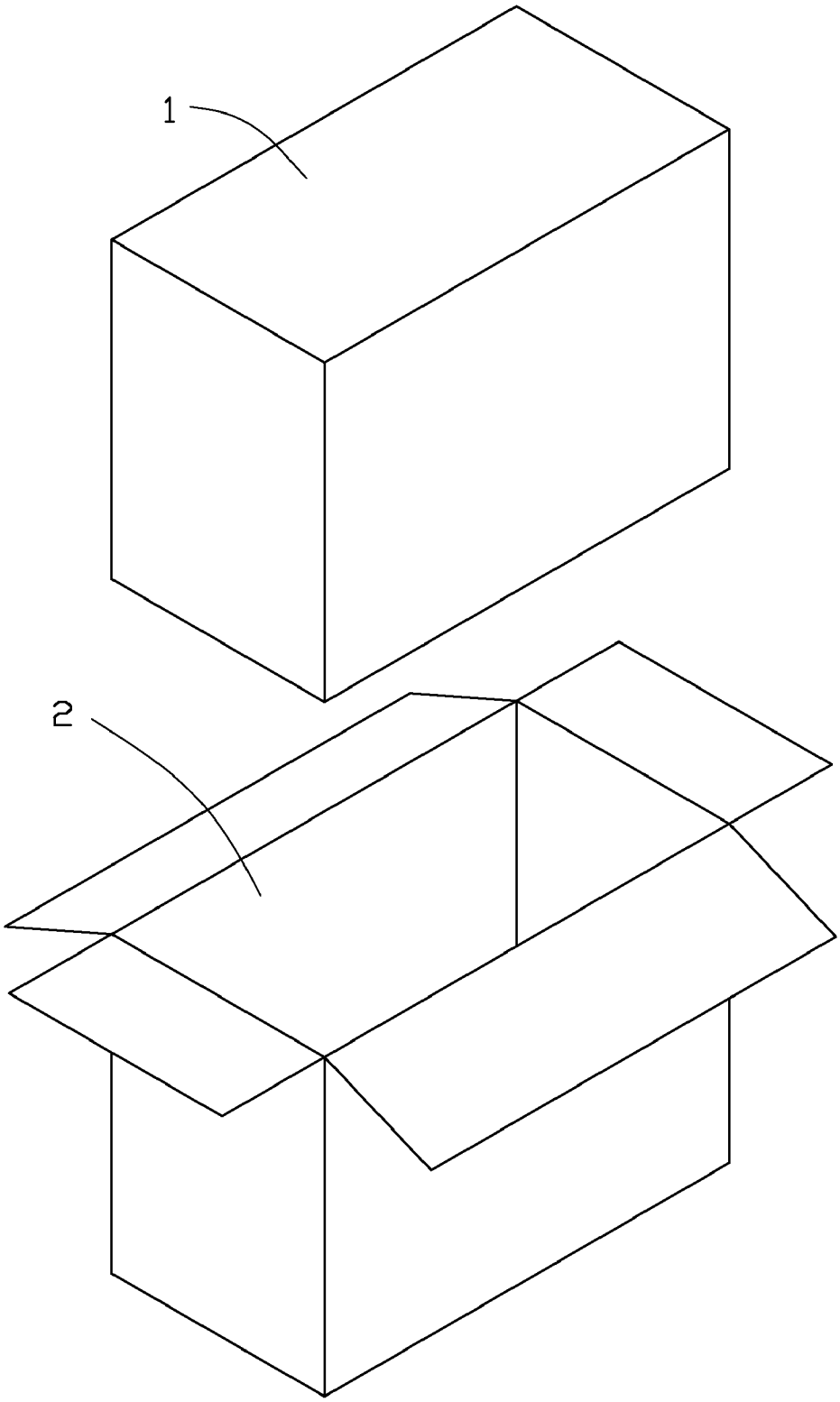
FIG. 1 (PRIOR ART)
FIG. 1 is an isometric view of a typical package for a product.
Figure 2:
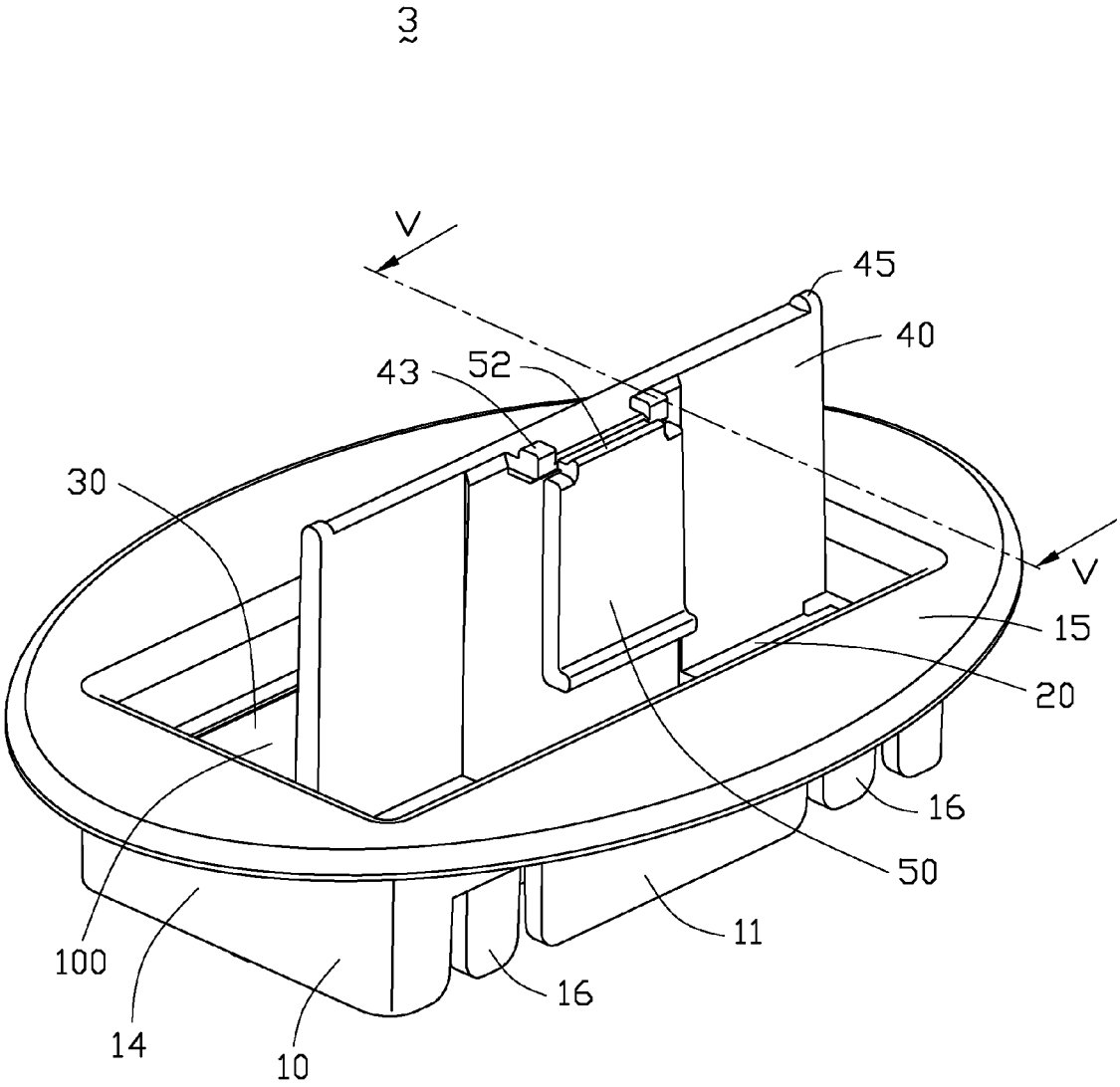
FIG. 2 is an isometric view of a fastening clip in accordance with an embodiment of the disclosure.
Figure 3:
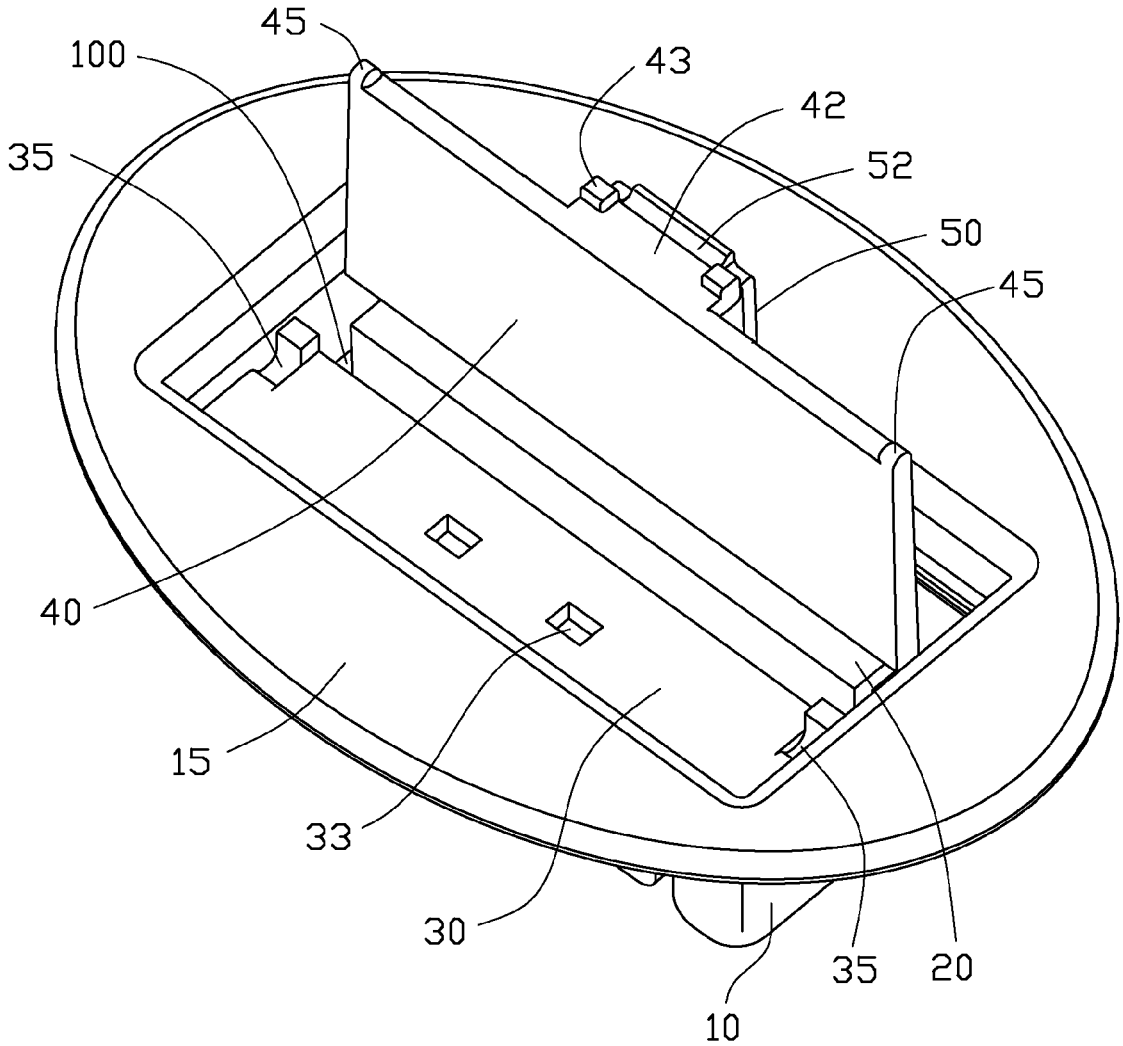
FIG. 3 is similar to FIG. 2, but viewed from another perspective.
Figure 4:
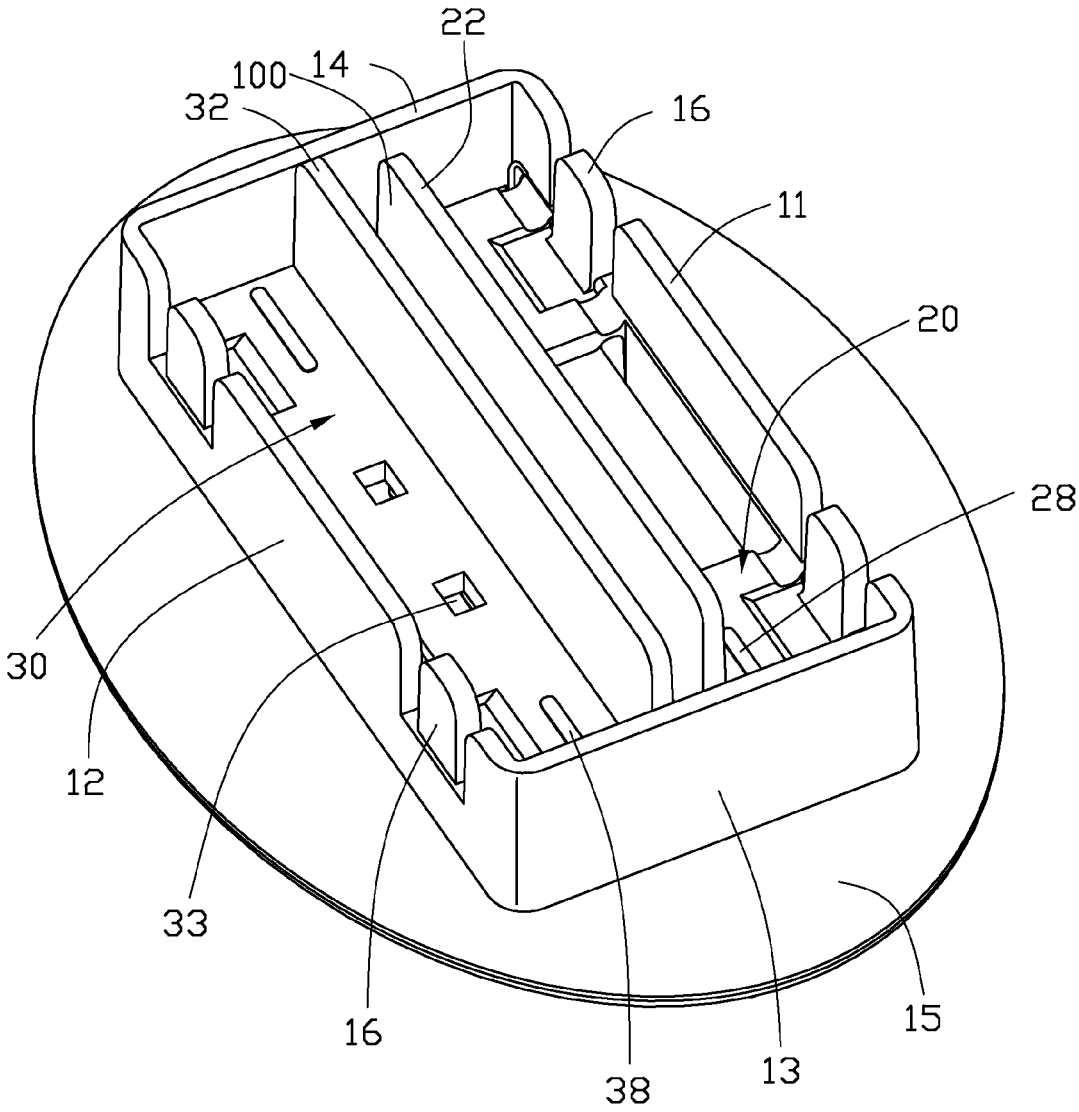
FIG. 4 is an inverted view of FIG. 3.

Referring to FIGS. 2 to 4, a fastening clip 3 is provided in accordance with an embodiment of the disclosure. While clip 3 is plastic formed by injection molding, those having ordinary skill in the art will readily recognize that a variety of materials can be utilized while remaining within the spirit and scope of the disclosure. The clip 3 includes a main body 10, a first clipping member 20, a second clipping member 30, and a latching mechanism 40.

The main body 10 includes a vertical first wall 11, a second wall 12 opposite and parallel to the first wall 11, a vertical third wall 13 connected between corresponding ends of the first and second walls 11 and 12, and a vertical fourth wall 14 opposite to the third wall 13 and connected between corresponding ends of the first and second walls 11 and 12. The main body 10 defines an opening 100 surrounded by the four walls 11, 12, 13, and 14. The opening 100 is configured for receiving the first clipping member 20, the second clipping member 30, and the latching mechanism 40. A flange 15 extends perpendicularly from the top ends of the walls 11, 12, 13, and 14. The edge of the flange 15 is substantially ellipseshaped. Each of the first and second walls 11 and 12 defines two cutouts, each for receiving an elastic piece 16 that extends from the main body 10.

Figure 5:
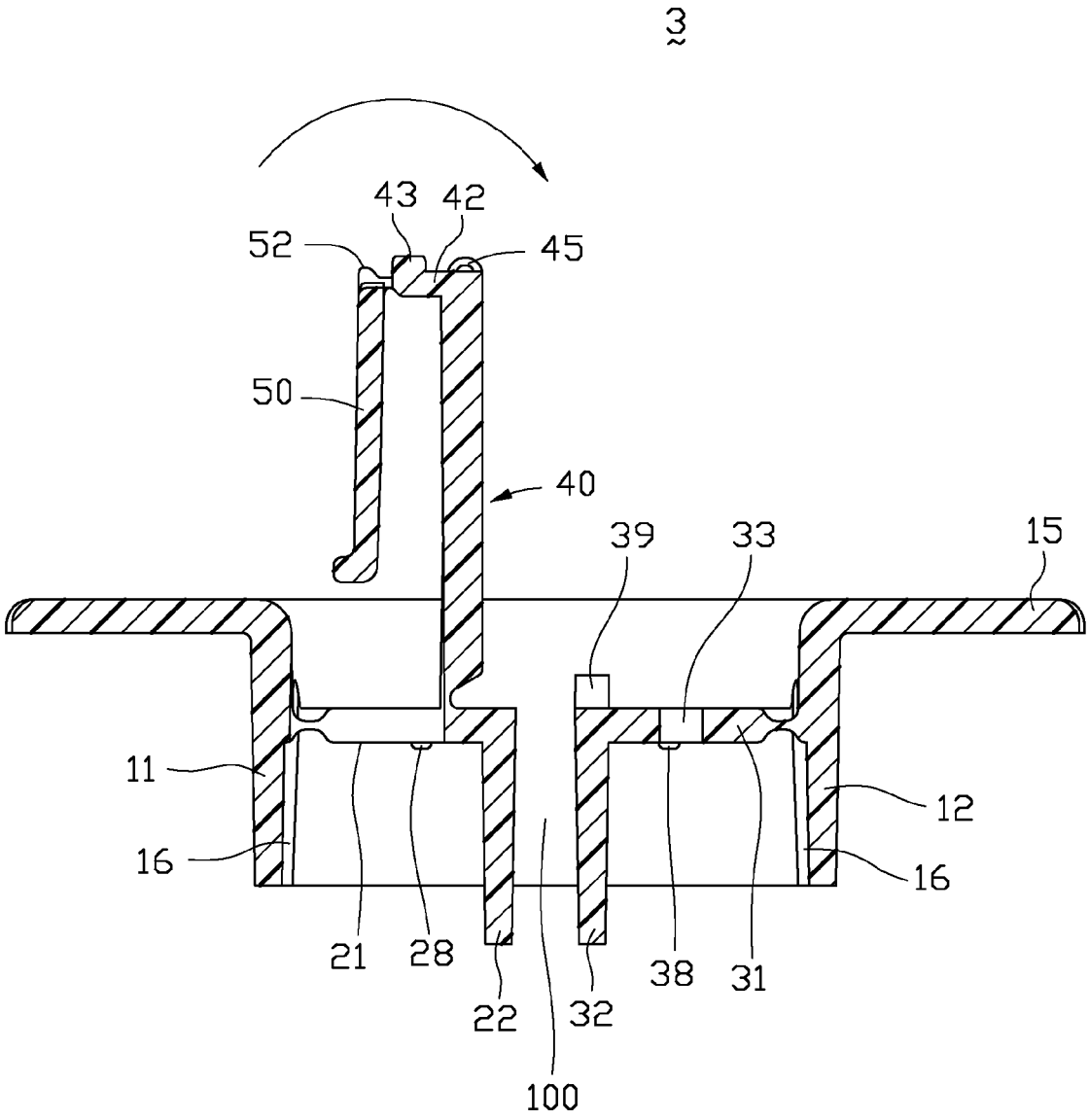
FIG. 5 is a cross-sectional view taken along the line V-V of FIG. 2.

Referring also to FIG. 5, which shows a released clip 3 in a released state. The first clipping member 20 includes a first leg 21 perpendicularly hinged on the first wall 11 of the main body 10, and a first foot 22 extending perpendicularly down from a distal end of the first leg 21. Two bar-shaped protrusions 28 extend from a bottom of the first leg 21 corresponding to the elastic pieces 16 of the first wall 11.

The second clipping member 30 includes a second leg 31 perpendicularly hinged on the second wall 12 of the main body 10, and a second foot 32 extending perpendicularly down from a distal end of the second leg 31. The second leg 31 is aligned with the first leg 21. Two bar-shaped protrusions 38 extend from a bottom of the second leg 31 corresponding to the elastic pieces 16 of the second wall 12. Two latching holes 33 are defined in the second leg 31 between the protrusions 38.

The latching mechanism 40 includes a board extending perpendicularly up from the first leg 21 of the first clipping member 20. A tab 42 extends perpendicularly from a free end of the board. Two latching blocks 43 extend from the tab 42 corresponding to the latching holes 33 of the second leg 31. A release tab 50 is hinged on the free end of the tab 42. A tongue 52 extends from a top end of the release tab 50.

Figure 6:
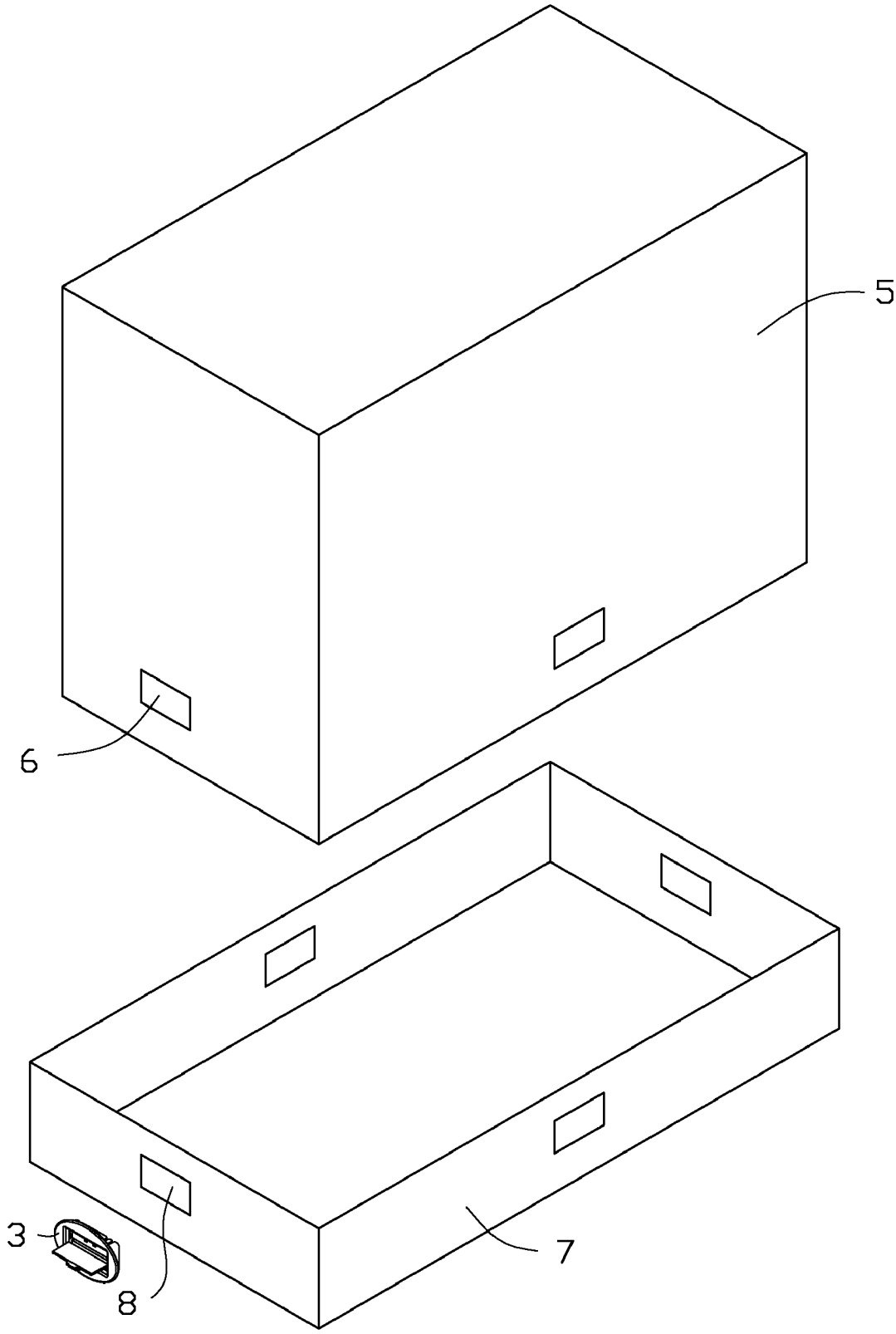
FIG. 6 is an exploded, isometric view of a package in accordance with an embodiment of the disclosure, the package using the fastening clip of FIG. 2.
Figure 7:
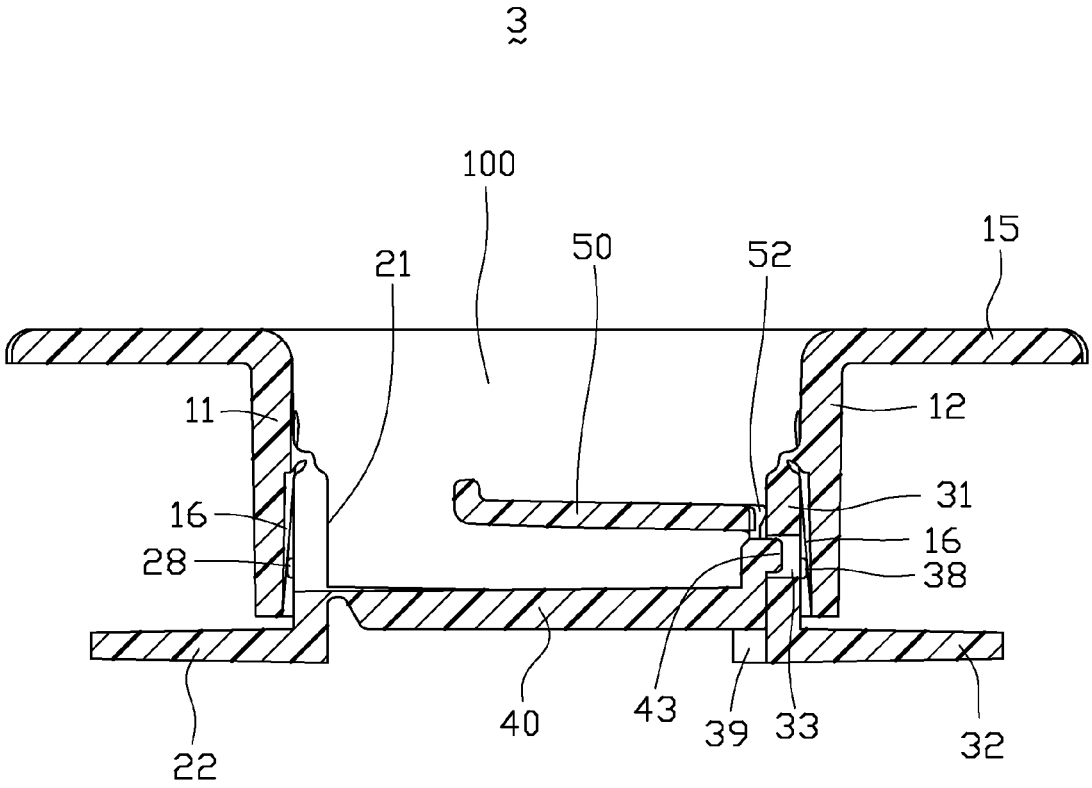
FIG. 7 is similar to FIG. 5, but shows the fastening clip in a clipping state.

Referring also to FIG. 6, clip 3, in accordance with the disclosure, holds multiple bodies of a package together. The package includes a lower body 7 for supporting a product to be packaged, and an upper body 5 for covering the product. The upper body 5 is substantially a cuboid-shaped box and has no bottom plate, while the lower body 7 is substantially a rectangular tray and has no top plate. In order to clip the two bodies 5 and 7 together, through holes 6 and 8, which are sized to fit the clip 3. One of the bodies 5 and 7 is received in the other and the through holes 6 and 8 are aligned to each other. The clip 3 is then placed into the through holes 6 and 8. Referring also to FIG. 7, the latching mechanism 40 is pushed down to spread the two feet 22 and 32, thus put clip 3 in a clipping state by engaging the clip 3 with the bodies 5 and 7 and coupling the two bodies 5 and 7 of the package.

When the clip 3 is engaged, the first leg 21 and the second leg 31 hingedly rotate approximately 90°, and the first foot 22 and the second foot 32 extend from the main body 10 and spread in opposite directions. Because the span of the spreaded feet 22 and 32 now exceeds that of the through holes 6 and 8 in the upper and lower bodies 5 and 7, the feet 22 and 32 and the flange 15 sandwich the corresponding side plates of the lower and upper bodies 5 and 7, thereby securely attaching the package.

When the clip 3 turns from the released state to the clipping state, the latching mechanism 40 rotates the first leg 21, wherein the latching blocks 43 touch, then impel the second leg 31. The first and second legs 21 and 31 impel the corresponding elastic pieces 16. The elastic pieces 16 become deformed and apply pressure on the latching blocks 43 via the second leg 31. The latching blocks 43 extend into the latching holes 33. The elastic pieces 16 restore to cause the clip 3 to snap. The engagement between the latching blocks 43 and the latching holes 33 maintains the clipping state of the clip 3.

Figure 8:
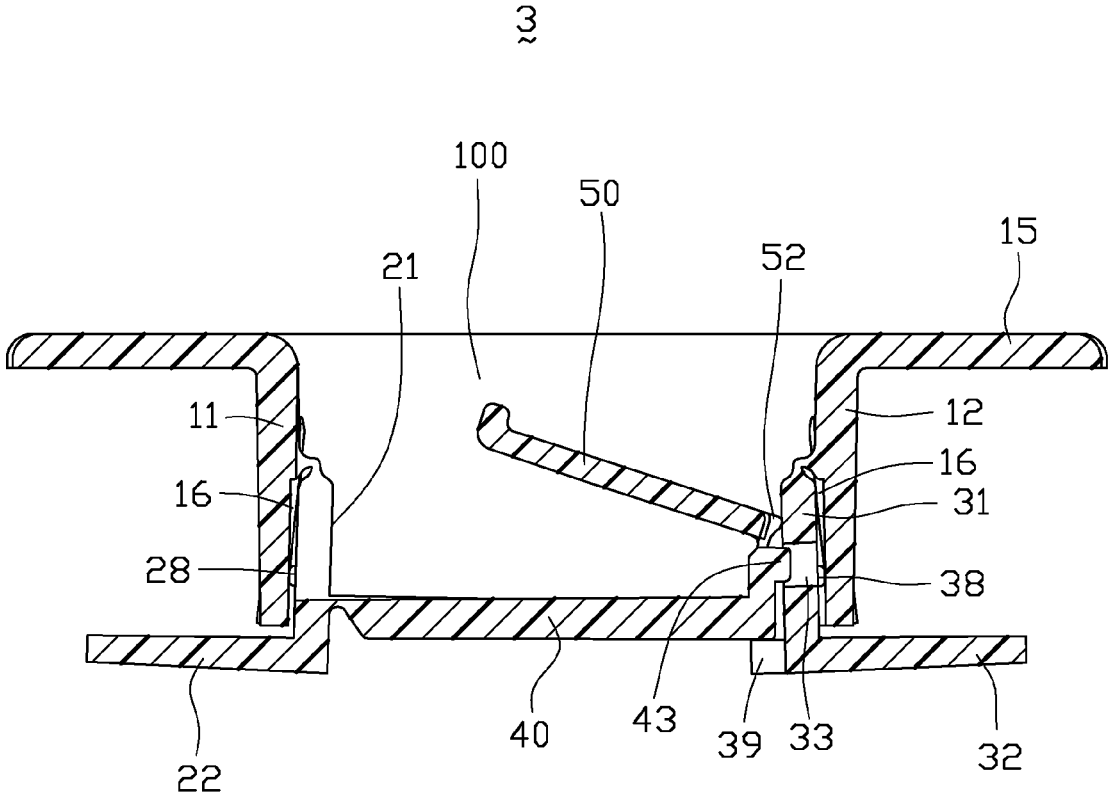
FIG. 8 is similar to FIG. 7, but shows the fastening clip to be released from clipping.

Referring to FIGS. 7 and 8, clip 3 remains closed until the release tab 50 is operated to rotate relative to the tab 42 of the latch mechanism 40. This causes the latching blocks 43 to disengage from the latching holes 33, thereby allowing the latch mechanism 40 to rotate back. When the release tab 50 is operated, a free end of the release tab 50 is turned upwards, the tongue 52 impels the second leg 31 to rotate toward the second wall 12, and the protrusions 38 impel the corresponding elastic pieces 16 to further deform. At the same time, a corresponding reaction force causes the latch mechanism 40 to drive the first leg 21 to rotate relative to the first wall 11, and the protrusions 28 impel the corresponding elastic pieces 16 to further deform. Thus, the latching blocks 43 can disengage from the latching holes 33. Then, the release tab 50 is pulled upward to drive the latch mechanism 40 to further rotate back, thereby releasing the clip 3.

During packaging, a product is initially placed into the lower body 7 and then covered by the upper body 5. Subsequently, the clips 3 couple bodies 5 and 7 together. Thus, the product is securely received in the package. The use of clips 3 in the packaging process allows convenient placement and extraction of the product. Moreover, the clips 3 are reusable.

Further referring to FIG. 3, two protrusions 45 extend from the free end of the board of the latching mechanism 40, with two grooves 35 being correspondingly defined in the second leg 31. The protrusions 45 can engage with the grooves 35 to further reinforce fastening when in the clipping state. Referring to FIG. 7, a support cantilever extends from the second leg 31. The extending direction is aligned with, and opposite to, the second foot 32. When the first and second clipping members 20 and 30 rotate and achieve the clipping position, the support cantilever 39 supports the free end of the board of the latching mechanism 40 to prevent the latching mechanism 40 from further rotating due to undesired external forces.

It is to be understood, however, that even though numerous characteristics and advantages of the disclosure have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fastening clip comprising:

a main body comprising opposite first and second walls, and a flange extending from the first and second walls;

a first clipping member comprising a first leg hinged on the first wall, and a first foot extending from the first leg;

a second clipping member comprising a second leg hinged on the second wall, and a second foot extending from the second leg; the second leg comprising a first latching portion; and a latching mechanism comprising a board extending from the first leg, a second latching portion, and a release tab hinged on the board;

wherein when the latching mechanism together with the first clipping member is rotated, the latching mechanism is able to rotate the second clipping member until the second latching portion engages with the first latching portion and the first and second feet extend out of the main body; and an elastic piece extends from the second wall to bias the second clipping members to the latching mechanism, thereby preventing the second latching portion from disengaging from the first latching portion; and wherein when the release tab is operated, the release tab is capable of engaging with the second leg to make the second latching portion disengage from the first latching portion.

2. The fastening clip of claim 1, wherein the second latching portion comprises a latching block extending from the board, the first latching portion comprises a latching hole defined in the second leg, and the latching block is engagable with the latching hole.

3. The fastening clip of claim 1, wherein the second latching portion comprises two protrusions extending from a top of the board, the first latching portion comprises two grooves defined in the second leg, and the protrusions are engagable with the grooves.

4. The fastening clip of claim 1, wherein another elastic piece extends from the first wall, configured to bias the first clipping member towards the latching mechanism.

5. The fastening clip of claim 4, wherein two protrusions respectively extend from the first and second clipping members to engage with the elastic pieces.

6. The fastening clip of claim 1, wherein the release tab comprises a tongue configured to engage with the second leg.

7. The fastening clip of claim 1, wherein a support cantilever extends from the second leg configured to support the latching mechanism when the second latching portion engages with the first latching portion.

8. A package comprising:

two bodies capable of collectively constituting a container box, each comprising a sideboard, each of which defines a hole for receiving a clip, wherein the clip comprises a main body comprising opposite first and second walls, and a flange extending from the first and second walls;

a first clipping member comprising a first leg hinged on the first wall, and a first foot extending from the first leg;

a second clipping member comprising a second leg hinged on the second wall, and a second foot extending from the second leg; the second leg comprising a first latching portion; and a latching mechanism comprising a board extending from the first leg, a second latching portion, and a release tab hinged on the board;

wherein the clip is capable of alternating between a first position in which the first and second feet extend out of the main body with the sideboards being sandwiched between the flange and the first and second feet, and a second position in which the first and second feet arc received in the main body with the clip being disengaged from the sideboards;

wherein in the first position, the second latching portion engages with the first latching portion; an elastic piece extends from one of the first and second walls, to bias the corresponding one of the first and second clipping members to the other, thereby maintaining the engagement of the first and second latching portions; and wherein when the release tab is operated, the release tab is capable of engaging with the second leg to make the second latching portion disengage from the first latching portion.

9. The package of claim 8, wherein when the clip switches from the second position to the first position, the latching mechanism is rotatable together with the first clipping member, and the latching mechanism is able to rotate the second clipping member until the second latching portion engages with the first latching portion.

10. The package of claim 8, wherein the second latching portion comprises a latching block extending from the hoard, and the first latching portion comprises a latching hole defined in the second leg, wherein the latching block is engagable with the latching hole.

11. The package of claim 8, wherein the release tab comprises a tongue configured to engage with the second leg.

12. The package of claim 8, wherein a protrusion extends from one of the first and second clipping members corresponding to the elastic piece, configured to engage with the elastic piece.

13. The package of claim 8, wherein a support cantilever extends from the second leg configured to support the latching mechanism when the second latching portion engages with the first latching portion.

14. An apparatus comprising a clip, the clip comprising:

a main body defining a through hole;

a flange radially extending from the main body;

a first clipping member hinged on the main body;

a second clipping member hinged on the main body and defining a latching hole; and a latching mechanism extending from the first clipping member and comprising a latching block, and a release tab;

wherein the clip, in a first position comprises the first and second clipping members out of the through hole, and in a second position, comprises the first and second clipping members received in the through hole;

wherein in the first position, the latching block is engaged in the latching hole;

wherein when the release tab is operated, the release tab abuts against the second clipping member to make the latching block disengage from the latching hole.

15. The apparatus of claim 14, wherein when the clip switches from the second position to the first position, the latching mechanism is rotatable together with the first clipping member, and the latching mechanism is able to rotate the second clipping member until the latching block engages in the latching hole.

16. The apparatus of claim 14, wherein the release tab comprises a tongue configured to engage with the second clipping member.

17. The apparatus of claim 14, wherein an elastic piece extends from the main body, configured to bias one of the first and second clipping members.

18. The apparatus of claim 14, wherein a support cantilever extends from the second clipping member configured to support the latching mechanism when the latching block engages in the latching hole.

* * * * *